US005614917A

United States Patent [19]

Kennedy et al.

[11] Patent Number: 5,614,917

[45] **Date of Patent: *Mar. 25, 1997**

[54] RF SAIL PUMPED TUNED ANTENNA

[75] Inventors: John F. Kennedy, Dearborn; Paul A. Zoito, Southfield, both of Mich.

[73] Assignee: Ford Motor Company, Dearborn, Mich.

[ * ] Notice: The term of this patent shall not extend beyond the expiration date of Pat. No. 5,483,249.

[21] Appl. No.: 514,901

[22] Filed: Aug. 14, 1995

Related U.S. Application Data

[63] Continuation of Ser. No. 130,933, Oct. 4, 1993, abandoned.

[51] Int. Cl.[6] ..... H01Q 1/38

[52] U.S. Cl. ..... 343/846; 343/700 MS; 343/848

[58] Field of Search ..... 343/848, 846, 343/828, 829, 831, 700 MS, 713; H01Q 1/38

[56] References Cited

U.S. PATENT DOCUMENTS

| | | | |
|---|---|---|---|
| 3,811,127 | 5/1974 | Griffee et al. | 343/846 |
| 4,429,313 | 1/1984 | Muhs, Jr. et al. | 343/771 |
| 4,587,524 | 5/1986 | Hall | 343/729 |
| 5,241,322 | 10/1993 | Gegan | 343/700 MS |
| 5,483,249 | 1/1996 | Kennedy | 343/700 MS |

*Primary Examiner*—Michael C. Wimer
*Attorney, Agent, or Firm*—Roger L. May

[57] ABSTRACT

An antenna is provided on a circuit board which has an elongated stub, having an end connected through a dielectric to a ground plane. The ground plane/stub combination forms a resonant cavity. The stub has a electrically conductive sail for increasing the omnidirectionality and sensitivity of the antenna.

9 Claims, 1 Drawing Sheet

RF SAIL PUMPED TUNED ANTENNA

This is a continuation of application Ser. No. 08/130,933 filed Oct. 4, 1993 now abandoned.

INCORPORATION BY REFERENCE

The application is related to application entitled, "Tunable Circuit Board Antenna", Ser. No. 08/130,936 now U.S. Pat. No. 5,483,249, which is commonly owned, simultaneously filed herewith, and hereby incorporated by reference.

BACKGROUND OF THE INVENTION

The invention relates generally to antennas for receiving RF signals and more particularly increasing the sensitivity of a resonant cavity formed on a printed circuit board.

Some antennas formed on circuit boards have a resonant cavity defined by a ground plane on one side of the circuit board, a formed piece of stripline referred to as a stub on the other side of the circuit board and an electrical connection between them. The shape and length of the stub determines the resonant frequency of the cavity. Generally, the stub is formed of stripline shaped on a circuit board. However, due to their flat nature, antennas formed on circuit boards principally receive signals in the direction normal to the plane of the antenna and arriving at the stub side of the circuit board. Signals arriving at the ground plane side of the circuit board are substantially blocked from the cavity.

SUMMARY OF THE INVENTION

An advantage of the present invention is to increase the sensitivity of the antenna to reception of RF signals from directions other than the normal.

A preferred embodiment of the present invention includes a dielectric layer having a first side and a second side, an electrically conductive ground plane disposed on the first side, and an electrically conductive stub disposed on the second side having one end electrically connected to the ground plane for forming a resonant cavity that is excited by the RF signal when the RF signal arrives at the stub. An electrically conductive sail extends in a generally perpendicular direction from the stub electrically connected to the stub for increasing the directions by which the RF signal will excite the cavity.

DETAILED DESCRIPTION OF THE PREFERRED EMBODIMENT

Figure 1:
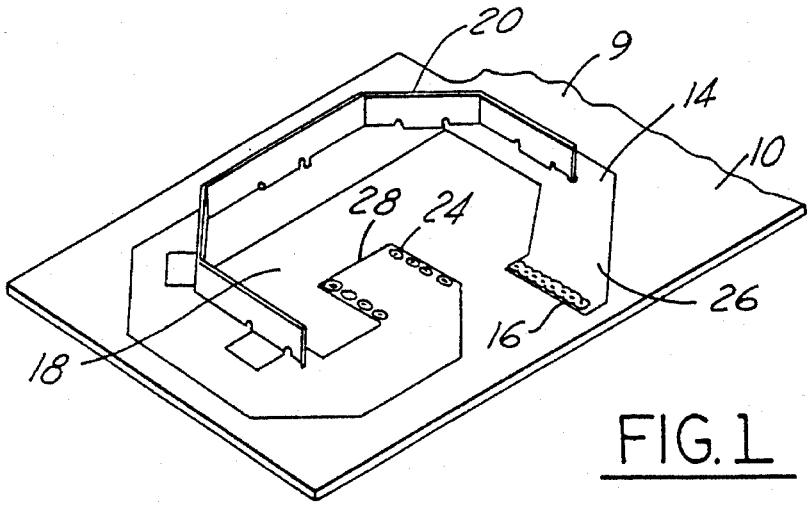
FIG. 1 is a perspective view of the preferred embodiment.
Figure 2:
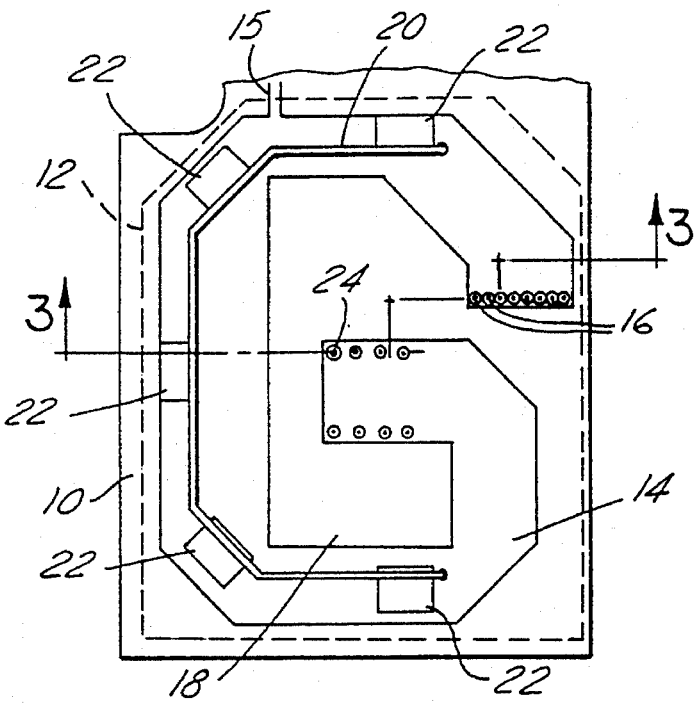
FIG. 2 is a top view of the preferred embodiment.
Figure 3:
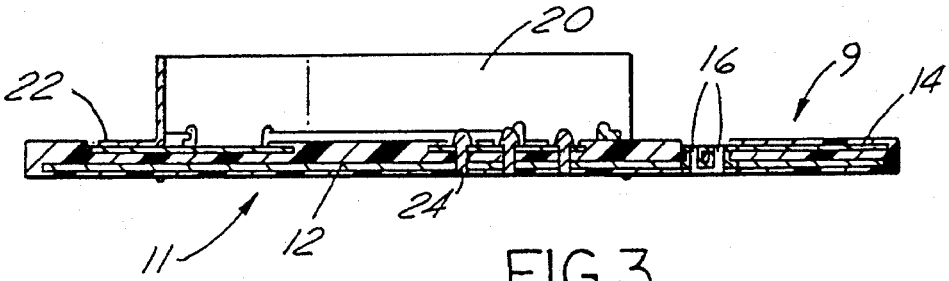
FIG. 3 is a cross-sectional view of the preferred embodiment.

Referring to FIGS. 1–3, circuit board 10 has a top side 9 and a bottom side 11 each containing a conductive layer. FIG. 1 is a perspective view of the top side. The top conductive layer of circuit board 10 is a stub 14 which is formed in the metallic layer. Stub 14 is a continuous elongated strip having a width which is formed to substantially enclose an area on the top surface of circuit board 10. In the preferred embodiment stub 14 is a "G" shape with a width which varies within limits of about 0.5 inches and about 0.75 inches. Stub 14 is connected to receiver circuitry (not shown) through feed 15. Stub 14 is made of a conductive material such as stripline and can also be made of a material such as silver coated copper. The resonant frequencies of the preferred embodiment are in the order of several MegaHertz. These high frequency signals travel on the outside boundaries of conductors such as stub 14. A highly conductive coating such as silver or copper on stub 14 is well suited to increase the "Q" value of the resonant frequency of the stripline.

The conductive layer on the bottom side 11 of circuit board 10 is a ground plane 12 comprised of a metallic layer of the same material. Ground plane 12 is sized to be at least as large as the area in the perimeter of stub 14. Ground plane 12 is electrically connected to a first end 26 of stub 14 by way of through holes 16 in a conventional manner. A second end 28 of stub 14 has a series of tuning holes 24 through circuit board 10.

Ground plane 12, through holes 16, stub 14, and tuning holes 24 form a closed cavity 18 for resonating at a radio frequency from a received RF signal. Circuit board 10 acts as a dielectric between ground plane 12 and stub 14. Circuit board 10 is preferably made of commonly known material such as FR4. A dielectric material with an even more desirable higher dielectric constant such as aluminum oxide or Teflon can be used. The resonant frequency of cavity 18 depends at least in part on the shape and length of stub 14. In a preferred embodiment, the resonant frequency of the antenna as shown was about 434 MHz with a bandwidth of about 18 MHz.

To increase the reception of signals along directions other than at the normal to the plane of cavity 18, a sail 20 is electrically connected to stub 14. Sail 20 is an electrically conductive strip formed perpendicularly from the plane of the top surface of circuit board 10. Sail 20 can be made of any conductor such as steel, however, a good conductor such as copper or silver coated copper is preferred. Sail 20 acts to pump RF energy received from directions substantially perpendicular to its surface into cavity 18. A placement of sail 20 at an angle other than perpendicular can be used; however, such a configuration introduces cosine error to the received signal thereby decreasing sensitivity. Sail 20 is preferably placed in the longitudinal center of the stub to reduce edge capacitance variation in the bandwidth of cavity 18. Sail 20 can vary in length for different applications, but for the most improvement in reception of the antenna 20, sail 20 should be a "C" shape or similar structure so that radio signals propagating in the plane of circuit board 10 will be effectively received by sail 20 regardless of direction within the plane. For example, a preferred shape of sail 20 includes at least three segments, each perpendicular to the plane of circuit board 10. The segments are placed end to end, each end forming an angle 45 degrees from its adjacent segment so that the segment generally forms a "C" shape. The closer the RF signal is to the normal of a sail segment the greater the reception.

FIG. 1 shows five adjacent segments, further increasing the omnidirectional sensitivity of the antenna. The shape of the sail is such that the average angle between various incoming RF signals and the most coincident normal of sail 20 is minimized. The length of the sides of the antenna should be of a length to receive adequate signal strength from any direction. In the preferred embodiment the smallest side is about 0.75 inches in length. Sail 20 should extend out from the top surface of the circuit board further than any other metallic objects such as covers (not shown) elsewhere on circuit board 10. The higher the sail the less effect it will have on the bandwidth and resonant frequency of the circuit. However, a large sail increases the size of the packaging.

Sail 20 extends 7 mm from the top surface of circuit board 10 in a preferred embodiment.

Sail 20 adds about a 2 percent change in the resonant frequency of the antenna. The frequency change can be compensated for in the shape of the antenna or by making the bandwidth of the antenna wide enough to accommodate the change. A continuous electrical connection joins sail 20 on its length to stub 14 (e.g., by soldering). However, for ease of manufacturing separate solder pads 22 can be provided to secure sail 20 to stub 14 along predetermined intervals of sail 20.

In addition, cavity 18 can be made tunable by providing tuning holes 24 in stub 14 as described in the reference incorporated by reference above In order to change the resonant frequency of cavity 12, holes 14 are selectively filled with solder or copper plating to electrically short stub 14 to ground plane 12. This will allow the adjustment of the resonant frequency of cavity 18.

The use of the RF antenna as described above is suitable for automotive applications because the limitations of the prior art have been overcome. The addition of the sail makes feasible a circuit board antenna suitable for a remote keyless entry of vehicle alarm system. The circuit board containing the antenna is preferably placed in the vehicle with the ground plane down and the antenna sail up so that the plane of the antenna is horizontal in a location such as under the instrument panel.

What is claimed is:

1. An antenna mounted on a circuit board for receiving a predetermined RF signal comprising:

a dielectric layer having a first side and a second side;

an electrically conductive ground plane disposed on said first side;

an elongated electrically conductive stub means disposed on said second side having two ends, each end electrically connected to said ground plane through conductive paths in said dielectric layer, said electrically conductive stub and said ground plane forming a closed resonant cavity that is excited by the RF signal when the RF signal arrives at said stub means, said stub means having a predetermined width; and electrically conductive sail extending in a generally perpendicular direction from said stub means electrically connected to said stub means, for increasing the propagating directions by which the RF signal will excite said cavity.

2. An antenna as recited in claim 1 wherein the shape of said stub means is a substantially G shape.

3. An antenna as recited in claim 1 wherein said sail has segmented sides.

4. An antenna as recited in claim 3 wherein said sail has three segmented sides.

5. An antenna as recited in claim 3 wherein each of said sides are placed at an angle 45 degrees from its adjacent sides.

6. An antenna as recited in claim 5 wherein said sail has segmented sides of at least 0.75 inches in length.

7. An antenna as recited in claim 1 wherein said sail is soldered to said stub means.

8. An antenna as recited in claim 7 wherein said sail has an edge completely soldered to said stub means.

9. An antenna as recited in claim 1 wherein said sail extends generally from the center of the width of said stub means.

* * * * *